United States Patent [19]

Radtke et al.

[11] 4,410,131

[45] Oct. 18, 1983

[54] HEATING AND AIR CONDITIONING SYSTEM

[75] Inventors: Wolfgang Radtke, Overath; György Borbely, Kerpen-Mödrath, both of Fed. Rep. of Germany

[73] Assignee: Schmidt Reuter Ingenieurgesellschaft mbH & Co. KG, Cologne, Fed. Rep. of Germany

[21] Appl. No.: 362,553

[22] Filed: Mar. 26, 1982

[30] Foreign Application Priority Data

Apr. 2, 1981 [DE] Fed. Rep. of Germany ..... 3113285

[51] Int. Cl.[3] ..... F25B 29/00; G05D 23/00

[52] U.S. Cl. ..... 236/10; 165/16; 236/47; 236/49; 237/69

[58] Field of Search ..... 236/49, 9 A, 47, 10; 165/16, 22; 237/69, 48; 98/31

[56] References Cited

U.S. PATENT DOCUMENTS

| | | | |
|---|---|---|---|
| 2,889,991 | 6/1959 | Follansbee | 237/69 X |
| 3,011,718 | 12/1961 | Joerren et al. | 236/49 X |
| 3,421,691 | 1/1969 | Forbes | 237/8 R X |
| 4,107,941 | 8/1978 | Hamilton | 62/186 |
| 4,199,101 | 4/1980 | Bramow et al. | 236/49 X |
| 4,315,596 | 2/1982 | Johnson, Jr. et al. | 165/11 R X |

*Primary Examiner*—William E. Wayner

*Attorney, Agent, or Firm*—Diller, Ramik & Wight

[57] ABSTRACT

A heating system for an inhabitable enclosure having a first heating system that maintains a first temperature in the absence of persons in the enclosure and a second heating system that maintains a second elevated temperature using outside fresh air with control means to detect the presence of a person in the enclosure to energize the second system.

11 Claims, 5 Drawing Figures

Figure 1:
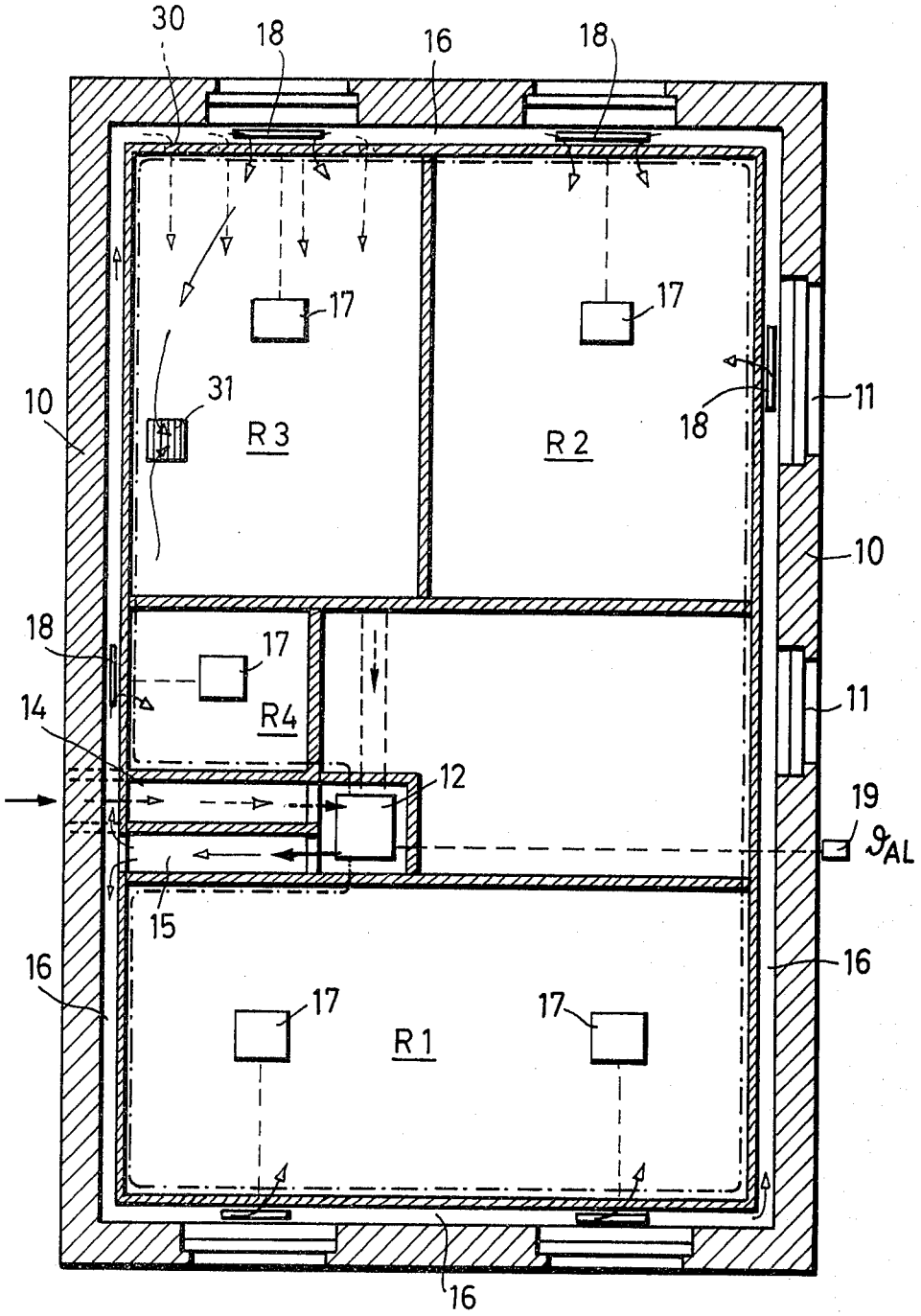

ϑ
23
21
22
28°C
20
22°C
-15
0
10
20
ϑAL [°C]

ϑ
Q
20°C
25
18°C
24
t1
t

HEATING AND AIR CONDITIONING SYSTEM

The invention relates to a heating and air conditioning system for a building having several rooms comprising a relatively inert basic heating system, in particular a wall or floor heating and an auxiliary heating system in the form of a quickly controllable hot-air heating.

The customary heating systems which are operating in the form of radiators, and, above all, the surface heating systems such as floor or wall heating assemblies are of a great thermal inertness. In other words, their reaction concerning temperature variations in the corresponding rooms is only slow, so that the actual temperature value may considerably deviate temporarily from the desired value set for inst. at a thermostat. Room ventilation is ensured in that persons present in the room are opening the windows. As a result, temperature variations are high and heat losses are great because heat recovery from the air is impossible this way and because great amounts of heat are supplied by the heaters just with open windows.

In contradistinction thereto, a hot air heating supplying heated air into the room is of a relatively quick reaction. However, hot air heatings are disadvantageous in that air has only a low heat-absorption capacity thus requiring the supply of considerable air amounts in case of an exclusive hot-air heating of a room.

To get along with little heating power in spite of the great amounts of air, recirculated air is used in said systems, in other words, air is returned from the rooms to the air conditioning device to be reheated there. However, at the same time, unpleasant odors can be conveyed to all heated rooms. In addition, admixed fresh air is always distributed uniformly to all rooms including the non-used rooms while used rooms do not get sufficient fresh air. A temporary decrease in temperature entails less comfort, because radiation to windows and cold walls is not compensated by heat reflection from hot heating surfaces.

To combine the advantages of both systems, there have been known combined heating plants which consist of an inert heating system covering part of the heat charge, the remaining heat requirement being met by more quickly reacting convectors, also by blowers. In this connection, the convector heating is a recirculated air heating, i.e. in the room to be heated, air is absorbed, heated and introduced again into said room. Fresh air must be supplied separately and its delivery is independent upon heat supply accordingly.

In the known heating systems, the sudden introduction of cold fresh air causes considerable problems of temperature control in the room because, by the supplied fresh air, the temperature balance is greatly affected.

It is the object of the invention to provide a heating and air conditioning system in which heating and air conditioning of the individual rooms is realised to the extent at which such rooms are used to avoid unnecessary expenditure of heating energy. At the same time, a temporary decrease and rise of the room temperature shall be realised quickly as with a hot-air heating without entailing the disadvantages of the hot-air heating such as odor transmission and imperfect distribution of outside air also to unused rooms.

To solve said posed problem, the invention provides a heating and air conditioning system of the above mentioned type in which (a) the auxiliary heating system is fed by fresh air supplied from the outside in a constant amount, (b) by the auxiliary heating system, fresh air of a uniform temperature is made available to all rooms, and (c) each room contains at least one air amount controlling means to adjust the supply of heated fresh air and which is regulated by a thermostat which can be switched over between a low first desired temperature value and a higher second desired temperature value, via a switch operable manually by a person entering the room or via a detector being automatically responsive and (d) the temperature of fresh air is controlled subject to the total air requirement in several rooms.

The idea underlying the invention is that rooms unused temporarily, or rooms in which no person is present and in which the temperature level should be kept relatively low do not require additional air conditioning. The natural ventilation through leaks in windows and doors etc. will do. Said rooms will be heated to a minimum temperature only by the basic heating. Rooms in which the temperature level shall be higher, i.e. rooms which are used, are additionally provided with heated fresh air so that said rooms are heated additionally, on the one hand, while fresh air is delivered, on the other hand. The temperature of hot air to be supplied to the rooms is constant in the total building, the temperature being regulated by a control of the hot air amount to be delivered to the individual room. In other words, air conditioning is realised to the extent to which additional heat is supplied by hot air. If the room is not used any longer, a switch-over to the lower desired temperature value is performed and the supply of fresh air is saved there.

The invention is based on the idea that normally, a certain number of persons, e.g. three or four persons is not exceeded in a used room of a flat, a single-family house or in an office unit. If, in case of particular occasions, more persons are present in the room, surplus heat will be developed by their body heat in the well heat insulated rooms. If so, airing can be ensured by opening doors or windows in the usual manner. However, said rare cases shall be disregarded for the explanation of the inventive idea. For such cases, it is possible, if necessary, to establish a separate operating schedule in which the air system supplies a great amount of fresh air having a low temperature.

In a normal performance of the heating and air conditioning system, the supply air current (hot air current) will be conducted only into the used rooms. If only one room is used, the total hot air of the central air conditioning device is available for said sole room, while all other rooms are heated at the adjusted minimum temperature exclusively by the basic heating system. The control of the supply air amount is performed by a thermostat, so that the supply air current is constantly reduced upon reaching the corresponding effective desired value of the room temperature.

As soon as a person enters the room, the auxiliary heating system is connected and the temperature is increased from the low basic temperature to the higher desired temperature. If the person leaves the room again, the low basic temperature is reset. The presence detectors required to this effect have been known from burglar alarm systems. For inst. infrared sensors can be used which detect the presence or change of warm bodies in the room, or ultrasound devices can be mounted which are operating according to the Doppler-principle. Other types of presence detectors may be also taken into consideration. For inst. the actuation of a selector switch or the closing of a door contact may be responsive to a higher desired temperature value.

It is the advantage of the heating and air conditioning system of the invention that unused rooms can be kept at a lower basic temperature to be only heated to the higher desired value by the hot air heating, if a person enters the room. Due to the quick effect of the hot air heating, such temperature increase can be achieved within short, so that a lower temperature during the time of nonuse can be accepted without any sacrifice in comfort. Experience shows that a person entering a room of a still low temperature does not have a bad feeling. Only if the person is present in such room for a longer time, a too low temperature causes an uneasy feeling of coldness. This is avoided in the invention by the quick adaptation of the auxiliary hot air heating.

The quickly reacting hot air heating with a great power reserve permits to use a very simple design of the basic heating system. For inst. a simple floor heating comprising a temperature control subject to the outside temperature will be sufficient. Above all, a hollow floor heating is suited in which air is circulating in the hollow space of a double floor. The heating efficiency of the basic heating system can be changed responsive to the heat effeciency required from the auxiliary heating system. If a high amount of air at a high temperature has to be supplied by the hot air heating for a long time, the regulator may increase the temperature of the basic heating system. On the other hand, the temperature of the basic heating system can be set to decrease if the heat and air amounts demanded for a longer time from the hot air heating are below a minimum value. In any case, the control of the auxiliary heating system (hot air heating) takes the priority over the control of the basic heating system.

Not only the basic heating but also the auxiliary heating requires a heat source. Normally, both heating systems are separated from each other, the basic heating system having a closed cycle for the circulation of the heat transfer medium. It is also possible to use one sole heat source only for the basic heating and the auxiliary heating. According to a specific embodiment of the invention, it is, therefore, provided that the basic heating system is also a hot-air heating, that the recycled air flow of the basic heating system and fresh air are supplied to one sole heating source and that for each room, the air amount supplied to the air amount controlling means is branched off from the air amount supplied to the basic heating body of said room. This variant is particularly suitable if the basic heating system is a hollow floor heating.

In the simplest situation, the hot air heating supplies air at a constant temperature and in a constant total amount, the regulation for each room being exclusively performed by changing the air volume in said room. However, it is also possible to provide a certain range of variation for the hot air temperature within which a temperature control is made subject to the prevailing demand. To this effect, and according to an advantageous embodiment of the invention, sensors are provided to determine the total instantaneous demand of hot air in all rooms.

An increase in hot air temperature is caused by the sensors, if the opening of the air outlets is greater than predetermined. In other words, the temperature control of a room is effected primarily by the control of volume of supplied hot air, and, in the second instance, also the hot air temperature can be changed within certain limits. In the third instance only, the temperature of the basic heating system is changed, if necessary.

The sensors for detecting the total instantanous requirement of all rooms may be for inst. limit switches responsive to the opening position of the air outlets. If more than a predetermined number of air outlets is completely open, the hot air temperature can be increased.

Alternatively, the sensors may be also responsive to the pressure in the hot air distributing system. The pressure is the lower, the greater the opening of the air outlets. If the pressure drops below a specific minimum value, it can be concluded that the heating efficiency of the hot air is not sufficient thus calling for an increase of the hot air temperature.

If an increase of the hot air temperature is not possible any longer, the air amount can be increased temporarily via the normal outside air amount.

By opening windows or doors, considerable losses in energy and control variations can be caused by the cold air admitted to the room. According to an advantageous embodiment of the invention, this can be avoided by controlling the thermostats by door and/or window contacts. An open door or window will interrupt the airing and the additional heating, thus excluding unnecessary hot air loss.

The invention will be explained hereinafter in detail with reference to the Figs. showing the embodiments.

Figure 2:
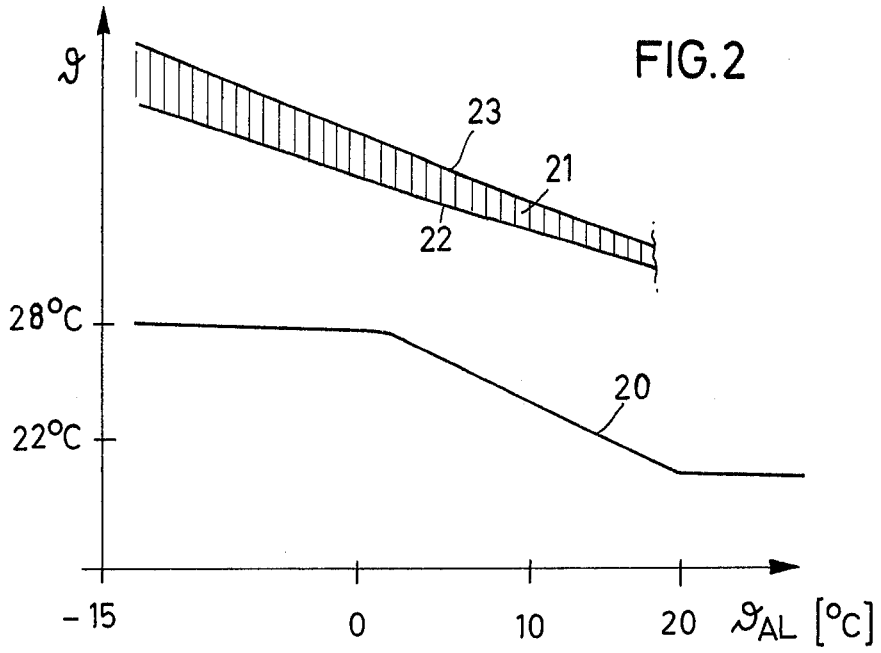
Figure 3:
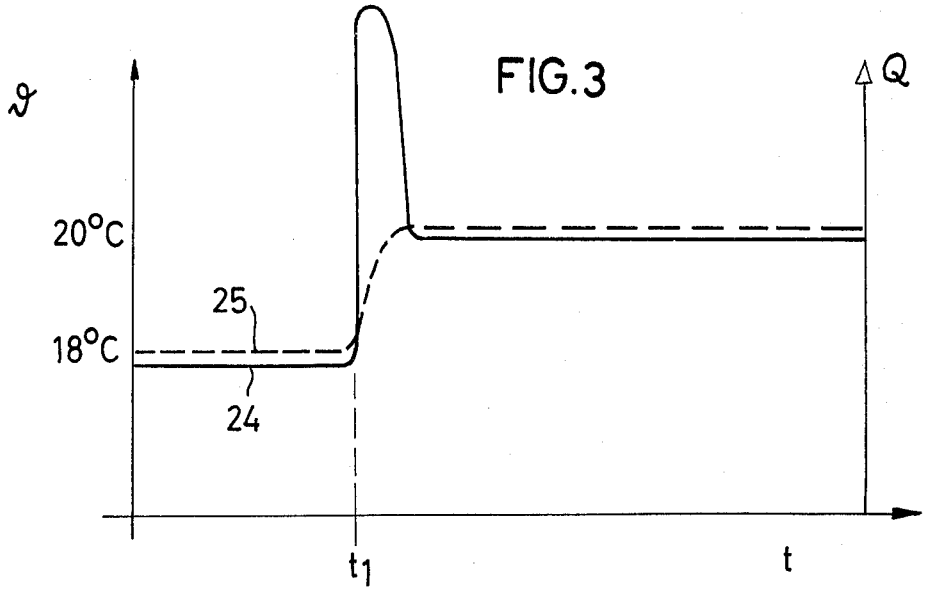
Figure 4:
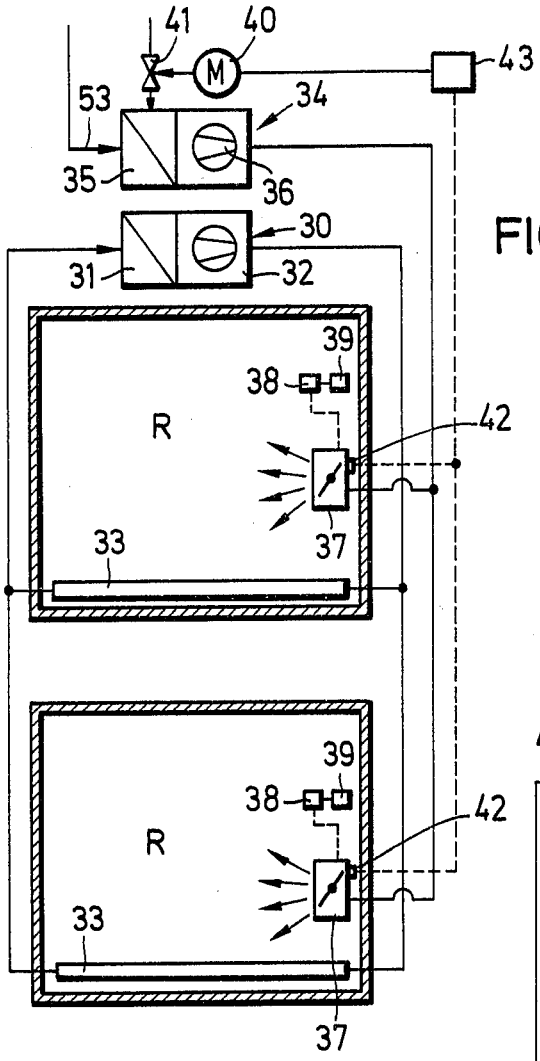
Figure 5:
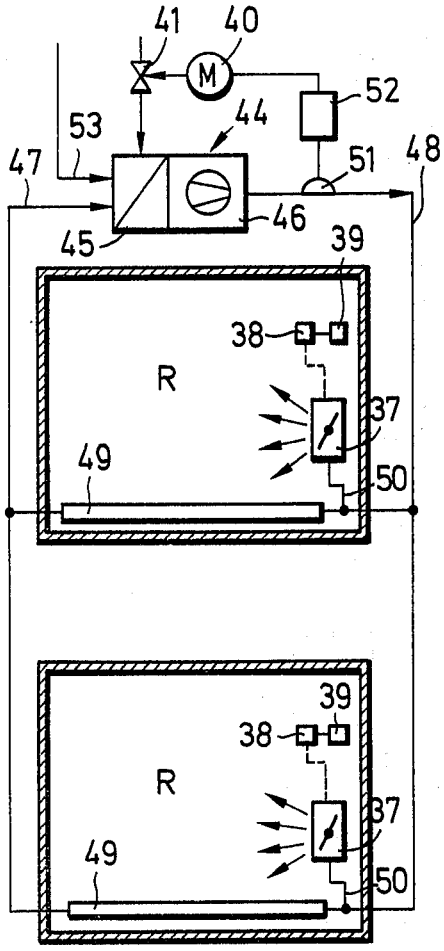

FIG. 1 is a plan view of a flat showing one embodiment of the heating and air conditioning system, FIG. 2 is a graph showing the temperature control of the basic heating system dependent upon the outdoor temperature, the temperature range of the hot air control being illustrated additionally, FIG. 3 shows the variations of the supplied amount of hot air and of the temperature in case of a sudden connection of the additional heating system to the basic heating system, with respect to time, FIG. 4 is an embodiment of the heating system comprising a closed cycle for the basic heating system and FIG. 5 is another embodiment in which the air lines of the basic heating system and of the additional heating are combined so as to require one sole heat source only.

FIG. 1 is a schematic plan view of a one-family house completely enclosed by the outer walls 10 which are provided with windows and doors 11.

The total floor of the building is a double floor containing a hollow space, the floor top resting by a plurality of (non-illustrated) supports on the bottom consisting of inst. of concrete. Hot air is conducted through the double floor hollow space so that the floor top will take a surface temperature within the range of 22° C. to 28° C. The ventilating system of the double floor hollow space is a closed circulating air system, i.e. the air contained in it is continuously circulating between a heater 12 and the double floor hollow space thus preventing the air from getting into the rooms. To be sure that the air is uniformly distributed in the double floor hollow space over the total cross sectional surface of the building, the double floor hollow space contains air conducting elements to conduct the bigger amount of circulating hot air along defined ways. In this example, the floor heating is the basic heating system.

The heater 12 also causes an additional heating. By the channel 14 communicating with the outside air, the supply of outside air to the heater 12 is ensured. Said outside air is heated and gets into the hot air channel 15 which is connected to an annular channel 16 extending along the outer wall 10 and passing through all rooms considered for heating. The annular channel 16 is made for inst. of sheet metal.

In the individual rooms R1, R2, R3 and R4 to be heated, said annular channel 16 is provided with air outlets or room air inlets 18 having an adjustable cross section. The size of the outlet cross section of each air inlet 18 is adjusted by a room thermostat 17.

Air temperature of the floor heating is set by an outside temperature feeler 19 dependent upon the outside temperature.

FIG. 1 shows in room R3 an additional variant also applicable to the other rooms. As evident, openings 30 are provided between the annular channel 16 and the hollow floor. Hot air flows through said openings 30 into the hollow floor space to heat it accordingly.

To increase the hot air flow rate flowing through the room R3, an opening 31 is provided in room R3 to absorb room air into the hollow floor space. Said air is heated on its way to the heater 12 in the hollow floor thus increasing the amount of air supplied to the heater 12 and raising by preheating the temperature of said air amount.

FIG. 2 shows the control characteristics 20 of the floor temperature dependent upon the temperature $\theta_{AL}$ of outside air.

At an outside temperature of 20° C., the temperature of the floor heating is set so as to result in a floor temperature of 22° C. With a drop of the outside temperature of 0° C., the floor temperature is set to rise to 26° C.

With additional cooling, the floor temperature is maintained at 26° C. Experience shows that such a floor temperature gives a room temperture of 18° C., which is the basic temperature to which the rooms are preheated. In general, such a temperature will not yet satisfy human well-being. Therefore, further heating of the rooms can be effected with heated fresh air by an auxiliary heating. The control characteristics 21 of the auxiliary heating are shown in FIG. 2. Line 22 reflects the temperature to which, subject to the outside temperature fresh air is heated by the heater 12. This refers to the temperature of the hot air flowing through the annular channel 16. First of all, said temperature is independent upon the temperatures in the individual rooms. Responsive to the opening cross sections of the corresponding air outlets 18, various amounts of hot air are conducted into the individual rooms R1 to R4. If persons are for inst. only present in room R3, the air outlets 18 of rooms R1,R2 and R4 are closed so that a temperature of 18° is maintained in said rooms on a long-term basis, and only in room R3, the temperature is set to rise to the desired value by the thermostat 17. In other words, the total hot air energy of the auxiliary heating or of the annular channel 16 is available for the room R3.

If, however, persons are present in all heatable rooms R1 to R4, the amount of hot air must be distributed witin all said rooms. As a result, the air outlets 18 of all rooms are opened in total or in part.

If all air outlets 18 are fully open, this will be detected by (non-illustrated) limit switches and, as a result, the heater 12 will be switched over to a higher hot air temperature of the auxiliary heating. The curve of this higher hot air temperature responsive to the outside temperature is shown by line 23 in FIG. 2. It is readily obvious that basically, the hot air temperature is set in dependence of the outside temperature. However, the hot air temperature may be higher if the demand of hot air is great.

In FIG. 2, the spent air system is not shown. Spent air will be expelled out of rooms R1 to R4, if heated fresh air is introduced into them. The spent air is evacuated through channels and can be used in a heat exchanger to preheat the fresh air absorbed by channel 14.

The continuous line 24 in FIG. 3 shows the heating power Q supplied into a room. The dotted line 25 shows the room temperature. At first, a temperature of 18° C. exclusively caused by the floor heating, prevails in the room. By a time switch or by a presence detector, the order of increasing the room temperature to 20° C. is given at the moment $t_1$. As a result, the air inlet 18 is fully opened to admit within a short time a high amount of hot air to flow into the room. The suppled (fresh) hot air simultaneously causes an intense aeration of the room. The heating power (curve 24) reaches a maximum value within a very short time, until the thermostat 18 is closing again partily the air inlet 18. Hence, on a long-term basis, the heating power is adapted to a value which corresponds to the room temperature of 20° C. determined by the thermostat 17. As apparent from FIG. 3, the desired room temperature is always reached within a very short time.

In the embodiment of FIG. 4, the basic heating system contains a heater 30 which consists of a heat exchanger 31 and of a pump or a ventilator 32.

The heat exchanger 31 is provided with heat via a heating boiler or a hot water line to heat the heat carrier medium circulating in a closed cycle of the basic heating system. Each of the rooms R connected to the basic heating system contains at least one basic heating body 33 which, in case of a hot air heating, may be for inst. the hollow space of a double floor, while it may be a steel radiator in case of a hot water heating. The inlet of each basic heating body 33 is connected to the outlet of the heating device 32 and the outlet of each basic heating body 33 is connected via corresponding channels or pipes to the inlet of the heating device 32.

A separate heating device 34 with a heat exchanger 35 and a blower 36 are provided for the auxiliary heating system. Outside air is absorbed through the heat exchanger via a duct 53. Upon its heating by the heat exchanger 35, outside air is supplied through the blower 36 to the air amount controllers 37 which are mounted in the individual rooms. Said controllers 37 include an air flap the opening position of which can be adjusted by a thermostat 38 mounted in room R to control via the thermostat 38 the amount of heated fresh air flowing into the room, by adjustment of the air amount control 37.

Each thermostat 38 has two different desired temperature values. The corresponding effective desired temperature value is set by a detector 39, which may be a switch actuated manually by a person entering the room, or which may be a presence detector automatically responsive if at least one person is present in the room. Upon actuation of the detector 39, the thermostat 38 is switched to the higher desired temperature value while, in case of an inactive detector 39, the thermostat 38 is setting the air amount control 38 so that the room temperature corresponds to the lower of the two preset desired temperature values. In general, the rotating speed of blower 36 is constant and not controlled. Therefore, the amount of fresh air flowing through duct 53 is constant as well. Said amount of fresh air will be distributed to a far extent in those rooms in which persons are present because the higher desired temperature value of the thermostat 38 is effective there while the lower desired temperature value is effective in the rooms without any person. Thus, rooms in which persons are present are heated and air-conditioned more intensely than the other rooms.

If a specific number of air amount controllers 37 is fully open, the resultant heat requirement is great. In this case, a valve 41 is opened via a motor 40 to ensure that a higher amount of hot water is supplied to the heater 34. Hence, the fresh air is heated to a higher temperature until at least some of the air amount controls 37 opened before completely will be closed at least partly. The condition with respect to the complete opening of the air amount controllers 37 is detected by a sensor 42 connected to a regulator 43 controlling the motor 40. The regulator 43 will detect whether a specific number of the connected air amount controllers 37 is in the maximum opening position.

In the embodiment of FIG. 5, the recycled air flow 47 of the basic heating system and the fresh air absorbed via line 53 are supplied simultaneously to the inlet of the heat exchanger 45 of the heater 44. Both air amounts are mixed and conducted in a constant amount via duct 48 to the different rooms R. Each room R has a double floor hollow space 49 or a hollow space below the floor. It constitutes the basic heating body connected to duct 48, on the one hand, to get hot air and connected to duct 47, on the other hand to recycle to the heater 44 the air upon the delivery of heat. In each room, at least one branch duct 50 is connected to line 48 or to the inlet of the double floor hollow space 49 which branch duct leads to an air amount controller 37 through which air is blown into the room R as illustrated in the embodiment of FIG. 4. Each of the air amount controllers 37 are controlled by a thermostat and a detector 39 just as explained in the preceding embodiment.

If a great number of air amount controllers 37 is opened due to a high heat requirement in the connected rooms the pressure in duct 48 drops. To detect the pressure drop, a pressure sensor 51 is applied to duct 48 causing via a regulator 52 the motor 40 to adjust the valve 41. Thus, with a higher heat requirement, more heat is supplied to the heater 44 via the valve 41 than with a lower heat requirement in rooms R.

The air amount passing duct 48 is constant irrespective of the heat requirement.

The hot fresh air supplied to rooms R via the air amount controllers 37 will escape from said rooms by the usual leaks present in walls, windows and doors.

What is claimed is:

1. A heating and air conditioning system for a building having several rooms comprising first basic heating system means for supplying heat uniformly to each of a plurality of rooms to maintain the rooms at a first predetermined temperature in the absence of persons in the rooms, second auxiliary heating system means for heating and selectively directing outside fresh air to any of the rooms in a quantity sufficient to elevate the first predetermined temperature thereof to a second higher temperature beyond said first predetermined temperature, and control means in each room for initiating the operation of said second auxiliary heating system means in response to the presence of a person in any particular room.

2. The heating and air conditioning system as defined in claim 1 wherein said control means includes thermostat means in each room for establishing the second higher temperature as a cut-off temperature to disable said second auxiliary heating system means.

3. The heating and air conditioning system as defined in claim 1 wherein said first basic heating system means is a hot air heating system, said first basic heating system means includes a sole source of hot air, duct means for circulating and recycling hot air between said sole source of hot air and the rooms to maintain the rooms at said first predetermined temperature, means for introducing the outside fresh air to said sole source of hot air, and said control means further includes means for selectively branching off hot air flowing through said duct means to any of the rooms to effect the second higher temperature therein.

4. The heating and air conditioning system as defined in claim 1 including a hollow floor system heated by said first basic heating system means.

5. The heating and air conditioning system as defined in any one of claims 1, 2, 3 or 4 including sensor means in each room for detecting the total instantaneous requirement of fresh air in all rooms, and said second auxiliary heating system means being responsive to said sensor means for heating outside fresh air in response to multiple room person presence.

6. The heating and air conditioning system as defined in claim 1 wherein said control means includes thermostat means in each room for switching over to said second higher temperature in response to the presence of a person in any particular room, and said switching over is effected by switch means manually operated by a person upon entering or within any room.

7. The heating and air conditioning system as defined in claim 1 wherein said control means includes thermostat means in each room for switching over to said second higher temperature in response to the presence of a person in any particular room, and said switching over is effected automatically by switch means automatically operated by a person entering or being within any room.

8. The heating and air conditioning system as defined in claim 1 including a hollow floor system heated by said first basic heating system means, and said hollow floor system also being heated by ducts from said second auxiliary heating system means.

9. The heating and air conditioning system as defined in claim 1 including a hollow floor system heated by said first basic heating system means, and an air-return duct between at lest one of the rooms and said hollow floor system.

10. The heating and air conditioning system as defined in claim 1 wherein said first basic heating system means and said second auxiliary heating system means is each an individual heat source, duct means for said second auxiliary heating system heat source for conducting heated outside fresh air to any of the several rooms, said control means including a variably controlled valve for selecting the quantity of hot air directed into each room from said duct means, and said control means further including thermostat means in each room for establishing said second higher temperature by operating the associated variably controlled valve.

11. The heating and air conditioning system as defined in claim 10 including detecting means associated with each room for setting each thermostat means to its associated second higher temperature in response to the presence of a person in a particular room.

* * * * *